US007049524B2

(12) United States Patent
Belli et al.

(10) Patent No.: US 7,049,524 B2
(45) Date of Patent: May 23, 2006

(54) IMPACT-RESISTANT SELF-EXTINGUISHING CABLE

(75) Inventors: Sergio Belli, Leghorn (IT); Diego Tirelli, Sesto San Giovanni (IT); Paolo Veggetti, Monza (IT); Alberto Bareggi, Milan (IT)

(73) Assignee: Pirelli Cavi e Sistemi S.p.A., Milan (IT)

( * ) Notice: Subject to any disclaimer, the term of this patent is extended or adjusted under 35 U.S.C. 154(b) by 2 days.

(21) Appl. No.: 10/203,834

(22) PCT Filed: Feb. 20, 2001

(86) PCT No.: PCT/EP01/01874

§ 371 (c)(1),
(2), (4) Date: Dec. 2, 2002

(87) PCT Pub. No.: WO01/61711

PCT Pub. Date: Aug. 23, 2001

(65) Prior Publication Data

US 2003/0141097 A1 Jul. 31, 2003

Related U.S. Application Data

(60) Provisional application No. 60/185,120, filed on Feb. 25, 2000.

(30) Foreign Application Priority Data

Feb. 21, 2000 (EP) ..... 00103593

(51) Int. Cl.
*H01B 7/00* (2006.01)

(52) U.S. Cl. ..... 174/120 R; 174/121 A

(58) Field of Classification Search ..... 174/110 R, 174/110 SR, 110 N, 110 D, 110 FC, 110 S, 174/110 F, 113 R, 116, 120 R, 121 R, 121 A
See application file for complete search history.

(56) References Cited

U.S. PATENT DOCUMENTS

| | | | | |
|---|---|---|---|---|
| 3,576,940 A | * | 5/1971 | Stone et al. | 174/113 R |
| 4,104,210 A | | 8/1978 | Coran et al. | |
| 4,145,404 A | | 3/1979 | Miyata et al. | |
| 4,367,295 A | * | 1/1983 | von Bonin | 521/165 |
| 4,510,348 A | * | 4/1985 | Arroyo et al. | 174/121 A |
| 4,513,173 A | * | 4/1985 | Merry | 174/121 A |
| 4,673,620 A | | 6/1987 | Shulman et al. | |

(Continued)

FOREIGN PATENT DOCUMENTS

CA 2 157 322 3/1997

(Continued)

OTHER PUBLICATIONS

Nippon Petrochemicals Co Ltd., "Flame Retardant Expandable Compsn. for Mouldings—Has Thermoplastic Polyolefin, Flame Retardant, Forming Agent, Crosslinking Agent and Surface Cpd. Opt. Contg. Thermoplastic Resin", Derwent Abstract of JP 02-978524B, (Nov. 15, 1999.).

(Continued)

*Primary Examiner*—William H. Mayo, III
(74) *Attorney, Agent, or Firm*—Finnegan, Henderson, Farabow, Garrett & Dunner, L.L.P.

(57) ABSTRACT

Self-extinguishing cable, in particular an electrical cable for low-voltage or medium-voltage power transmission or distribution of data transmission, having at least one conductor and at least one flame-retardant coating positioned externally to the conductor. The flame-retardant coating is produced from an expanded polymeric material which incorporates at least one intumescent agent.

32 Claims, 4 Drawing Sheets

U.S. PATENT DOCUMENTS

| | | | | | |
|---|---|---|---|---|---|
| 4,916,198 | A | | 4/1990 | Scheve et al. | |
| 5,153,381 | A | | 10/1992 | Ganatra et al. | |
| 5,182,049 | A | * | 1/1993 | von Bonin | 252/378 R |
| 5,462,803 | A | * | 10/1995 | Wessels | 428/380 |
| 5,552,185 | A | * | 9/1996 | De Keyser | 427/358 |
| 5,578,666 | A | * | 11/1996 | Weil et al. | 524/100 |
| 5,597,981 | A | * | 1/1997 | Hinoshita et al. | 174/110 R |
| 5,604,024 | A | * | 2/1997 | von Bonin | 442/6 |
| 5,644,105 | A | * | 7/1997 | Castellani | 174/110 SR |
| 5,670,748 | A | * | 9/1997 | Gingue et al. | 174/120 R |
| 5,770,820 | A | * | 6/1998 | Nelson et al. | 174/113 R |
| 5,841,072 | A | | 11/1998 | Gagnon | |
| 6,153,668 | A | * | 11/2000 | Gestner et al. | 523/179 |
| 6,239,377 | B1 | * | 5/2001 | Nishikawa | 174/110 R |

FOREIGN PATENT DOCUMENTS

| | | | | |
|---|---|---|---|---|
| EP | 0 324 430 | | | 7/1989 |
| EP | 0 328 051 | | | 8/1989 |
| EP | 0 530 940 | | | 3/1993 |
| EP | 0 831 120 | | | 3/1998 |
| GB | 2 341 186 | | | 3/2000 |
| IT | WO 99/05688 | A | * | 2/1999 |
| JP | 54-113630 | A | * | 9/1979 |
| JP | 55-157640 | A | * | 12/1980 |
| JP | 60-202165 | A | * | 10/1985 |
| JP | 02-187434 | A | * | 7/1990 |
| WO | WO98/52197 | | | 11/1998 |
| WO | WO99/05688 | | | 2/1999 |

OTHER PUBLICATIONS

J.W. Lyons, "The Chemistry and Uses of Fire Retardants", Wiley-Interscience, New York, pp. 20-21, (1970).

J.W. Lyons, "The Chemistry and Uses of Fire Retardants Based on Phosphorus", Wiley-Interscience, New York, Chapter 2, pp. 29-74, (1970).

J.S. Dick, "Compounding Materials for the Polymer Industries", Noyes Publication, New Jersey, pp. 63, 144, and 359, (1987).

* cited by examiner

IMPACT-RESISTANT SELF-EXTINGUISHING CABLE

CROSS REFERENCE TO RELATED APPLICATIONS

This application is a national phase application based on PCT/EP01/01874, filed Feb. 20, 2001, the content of which is incorporated by reference herein, and claims the priority of European patent application No. 00103593.0, filed Feb. 21, 2000, the content of which is incorporated herein by reference, and the benefit of U.S. Provisional Application No. 60/185,120, filed Feb. 25, 2000, the content of which is incorporated herein by reference.

BACKGROUND OF THE INVENTION

Field of the Invention

The present invention relates to a self-extinguishing cable, in particular to a cable for low-voltage or medium-voltage power transmission or distribution, as well as to a cable for data transmission or for telecommunications, for example a telephone cable.

More particularly, the present invention relates to a self-extinguishing cable which has, in a position radially external to at least one conductive element, a polymer coating which has self-extinguishing properties with a low level of fume production, as well as mechanical properties capable of giving this cable excellent protection against accidental impacts.

In the present description, the expression "low-voltage" means a voltage of less than about 1 kV, while the expression "medium-voltage" means a voltage of between about 1 kV and about 30 kV.

In addition, the term "core" of the cable means a semi-finished structure consisting of a conductive element coated externally with at least one layer of electrical insulator. In the case in which a cable has only one "core", it is defined as being unipolar, when there are two cores the cable is defined as being bipolar, and so on.

DESCRIPTION OF THE RELATED ART

In general, a self-extinguishing electrical cable is produced by extruding over the abovementioned core or even directly over the conductor itself, i.e. over the uninsulated conductor, a flame-retardant coating. The flame-retardant coating may be obtained from a polymer composition which has been given flame-resistance properties by means of addition of a suitable additive.

It is known practice, for example, to add to such a polymer composition, for example a composition based on polyolefin (such as polyethylene or ethylene/vinyl acetate copolymers), a flame-retardant additive of halogenated type, for example an organic halide combined with antimony trioxide.

However, flame-retardant additives of halogenated type have numerous drawbacks since, during processing of the polymer, they decompose partially, generating halogenated gases which are toxic to the operatives and corrosive to the metal parts of the polymer-processing machines. In addition, when subjected to the direct action of a flame, the combustion of said additives generates very large amounts of fumes containing toxic gases. Similar drawbacks are also encountered when polyvinyl chloride (PVC) is used as polymeric base with antimony trioxide added.

Therefore, in recent years, the production of self-extinguishing cables has turned to the use of halogen-free compositions, in which a polymeric base, generally of polyolefin type, is mixed with flame-retardant inorganic fillers. These flame-retardant inorganic fillers are generally hydroxides, oxide-hydrates or hydrated salts of metals, in particular of aluminium or magnesium, such as magnesium hydroxide or aluminium trihydrate or mixtures thereof (see, for example, patents U.S. Pat. Nos. 4,145,404, 4,673,620, EP-328 051 and EP-530 940). Magnesium hydroxide is particularly preferred, since it has a relatively high decomposition temperature (about 340° C.) and satisfactory thermal stability (see, for example, patent application WO 99/05688 in the name of the Applicant).

However, the use of these inorganic flame-retardant fillers has a number of drawbacks. First is the fact that, in order to obtain an efficient flame-retardant action, very large amounts of the flame-retardant filler need to be added to the polymeric material, in general about 120–250 parts by weight relative to 100 parts by weight of polymeric material.

Such large amounts of filler lead to a decline in the processability and mechanical and elastic properties of the resulting compound, in particular as regards its elongation at break and its breaking load.

Unlike the compounds mentioned above, other inorganic substances (such as, for example, glass fibres, calcinated kaolin, calcium carbonate) do not undergo decomposition reactions at the usual combustion temperatures which might lead to products capable of actively interfering with the combustion process (for example, calcium carbonate decomposes at about 825° C.). These substances are used as inert fillers to produce a "dilution effect" in the polymeric material (see, for example, the volume "Compounding Materials for the Polymer Industries", J. S. Dick. 1987, Noyes publ., in particular pages 63 and 144), with the result that the combustibility of the compound is reduced as a consequence of the fact that there is less polymeric material which can burn per unit volume.

Another group of additives capable of producing a flame-retardant effect are phosphorus-based fire retardants (see, for example, "The chemistry and uses of Fire Retardants", chapter 2, J. W. Lyons, published by Wiley-Interscience, 1970). Typical compounds containing phosphorus which are suitable for use as flame-retardant additives may be salts of phosphorous or phosphoric acid (phosphates, phosphates or polyphosphates), organic esters or polyesters of phosphoric acid (mono-, di- or tri-alkyl or -aryl phosphates or polyphosphates), phosphites (mono-, di- or tri-alkyl or -aryl phosphites), phosphonates or polyphosphonates (mono- or di-alkyl or -aryl phosphonates or polyphosphonates).

Besides phosphorus-containing compounds, flame-retardant additives for polymeric compositions which can also be used are mixtures of phosphorus-containing and nitrogen-containing compounds, said mixtures generally being referred to as "P-N mixtures" (see "The chemistry and uses of Fire Retardants", J. W. Lyons, Wiley-Interscience (1970), page 20 and chapter 2). The nitrogen-containing compounds may include, for example, inorganic salts such as ammonium salts, or organic compounds and salts thereof, such as, for example, guanidine, melamine and derivatives thereof, for example melamine cyanurate or guanidylurea, and the salts thereof. As regards the use of said phosphorus-containing and nitrogen-containing compounds in mixtures ("P-N mixtures"), see, for example, patent EP-831 120 in the name of the Applicant.

During the phases of transportation or installation of a cable, this cable may suffer accidental impacts which may cause damage, even considerable damage, to its structure (for example deformations of the insulating layer, detachment between the layers constituting the cable). This damage may possibly result in variations in the electrical gradient of the insulating coating, with a consequent reduction in the insulating capacity of this coating.

In the cables currently commercially available, for example in electrical cables for power transmission or distribution, to protect these cables from damage caused by possible accidental impacts, use is generally made of metal armouring capable of imparting suitable mechanical strength. This armouring may be in the form of metal strips or wires (generally made of steel) or in the form of a metal sheath (generally made of lead or aluminium) and, usually, this armouring is in turn coated with an outer polymeric sheath. An example of this cable structure is described in U.S. Pat. No. 5,153,381. This armouring can also be envisaged for cables of self-extinguishing type, i.e. cables which have a flame-retardant coating as described above.

Document WO 98/52197, in the name of the Applicant, similarly illustrates the structure of an electrical cable for power transmission, comprising, in replacement for the metal armouring, a coating made of expanded polymeric material of suitable thickness capable of giving the cable high resistance to accidental impacts. This expanded polymeric coating is preferably located in a position immediately subjacent to the outer polymeric sheath.

The Applicant has perceived the need to prepare a self-extinguishing cable which, besides guaranteeing the required flame-retardant properties, is endowed with high impact resistance, i.e. an impact resistance at least equal to that of cables provided with metal armouring.

Specifically, it is known that in an ever-increasing number of applications and in the face of increasingly strict standards, it is of fundamental importance to install cables which are capable of ensuring high levels of safety. This is both in terms of flame resistance in the event of a fire, and in terms of mechanical strength in the face of possible accidental impacts to which the cable may be subjected during transportation or installation, or when in use.

For example, whenever cables need to be installed, in view or in suitable tunnel locations, in highly frequented environments that are extremely critical in the event of a fire (such as, for example, enclosed underground environments such as subway, railway tunnels and the like) it should be ensured, firstly, that these cables are self-extinguishing, produce a low level of fumes and do not emit toxic or corrosive gases. Second, they should be given a plurality of mechanical properties and resistance to external agents (heat, oils), making them easy to install and ensuring that they have good performance qualities and are long-lasting.

In consideration of these aspects, the need has arisen, especially with reference to the particular applications mentioned above, to have available on the market a self-extinguishing cable of armoured type. However, placing metal armouring inside a cable has considerable drawbacks. For example, it is necessary for this purpose to introduce one or more additional stages into the process for producing this cable. The process consequently becomes more complex also from the point of view of plant engineering, and more expensive, not only in economic terms but also in terms of time. In addition, the presence of metal armouring inside a cable entails a significant increase in the weight of this cable, which will result in an inevitable increase in costs, not only for the installation stage, but also for the transportation stage.

The Applicant has thus perceived the need to produce a new type of self-extinguishing cable which is capable of combining high mechanical properties with the required flame-retardant properties, while ensuring, at the same time, an inexpensive, simple and fast production process.

On the basis of the results obtained on cables of the non-self-extinguishing type, as described in the abovementioned document WO 98/52197, the Applicant initially considered inserting into a self-extinguishing cable an expanded polymeric coating in replacement for the reinforcing metal armouring, in order to prepare a cable which has high mechanical strength, is particularly light and is, moreover, fast and simple to prepare.

However, despite the undoubted advantages mentioned above, the Applicant found itself confronted with a problem which was not easy to solve since, although being particularly advantageous in terms of its mechanical resistance to impacts and its lightness, an expanded polymeric coating did not have the desired flame-retardant requirements. On the contrary, since said coating is expanded and thus contains oxidant air inside it, it was found to be particularly subject to rapid flame propagation.

The next approach explored by the Applicant was to attempt to make the abovementioned expanded polymeric coating flame-resistant by including in it a flame-retardant filler of inorganic type (for example magnesium hydroxide). However, the efforts made in this direction were unsuccessful. In point of fact, in order to obtain a coating which ensures the desired flame-retardant properties, it was found necessary, as indicated above, to use a large amount of flame-retardant filler which, on the other hand, did not allow expansion of the base polymeric composition.

SUMMARY OF THE INVENTION

The Applicant has now found that it is possible to obtain halogen-free self-extinguishing cables which, in the event of a fire, do not generate toxic or corrosive gases, produce a low level of fumes and are endowed with high flame resistance and excellent impact resistance. This is done by providing these cables with a layer of coating produced from an expanded polymeric composition incorporating at least one swelling agent as defined below.

The Applicant has moreover found that the flame-retardant expanded coating layer according to the present invention is capable in certain cases of giving the cable mechanical resistance to impacts which may even be greater than that of a similar cable of armoured type.

The present invention, as will emerge more clearly from the description which follows, provides an excellent solution to the problems mentioned above for the prior-art solutions illustrated previously in the course of the present description.

For example, a self-extinguishing cable having an expanded polymeric coating with flame-retardant properties does not require, as mentioned above, metal armouring to protect it against accidental impacts.

This represents a particularly advantageous aspect since, firstly, the cable according to the present invention is significantly lighter than conventional armoured cables, for a mechanical strength of equal value and occasionally greater than that of said armoured cables. As already recalled, the possibility of using a lighter cable makes its installation and transportation easier and consequently reduces its costs.

Secondly, the layer made of expanded material with flame-retardant properties according to the present invention is extruded directly onto the cable continuously, optionally also in co-extrusion with another layer of coating of the cable, such as the filler and/or the outer polymeric sheath. This aspect thus makes it possible to provide a production process which is greatly simplified in terms of plant engineering, as well as faster and less expensive than the processes for producing the armoured cables of the prior art.

In point of fact, providing reinforcing metal armouring inside a cable requires a predetermined sequence of steps, as well as the use of apparatus specifically dedicated to this type of operation. More specifically, if it is desired to obtain an armoured cable of the prior art, for example of unipolar type, the production process necessarily comprises:

a first line dedicated to extrusion of the insulating layer and the formation of the core of the cable which, once obtained, is wound on a first collecting reel;

a second line, separate from the first line and fed with a core unwound from an abovementioned first reel, its job being to position the metal armouring; the semi-finished product thus obtained is then wound on a second collecting reel;

a third line fed with said semi-finished product, its job being to extrude the flame-retardant outer polymeric sheath which covers the metal armouring and completes the cable production process.

The present invention, as outlined above and as will be explained in greater detail in the description hereinbelow, by virtue of excluding the armouring stage of the prior art, allows a simpler production process to be carried out, based on an operating procedure of continuous type. As a matter of fact, the armouring stage inevitably introduces a discontinuity into the cable production process, the effect of which is felt both in terms of a reduction in production efficiency and in terms of an increase in the plant engineering costs. In contrast, the flame-retardant coating made of expanded polymeric material according to the invention consists of a continuous layer distributed uniformly along the entire length of the cable.

In addition, the self-extinguishing cable according to the present invention is also particularly advantageous in the stage of producing a junction between two cables or if it is desired to make a connection between a cable and an electrical device. The expanded polymeric coating which replaces the metal armouring allows this junction or connection to be produced more simply and quickly. This is because it is less difficult and demanding to remove a portion of expanded coating (i.e. the portion of coating which covers the length of cable to be joined or connected) rather than a portion of armouring.

The present invention can be applied advantageously not only to electrical cables for power transmission or distribution, but also to cables for data transmission or to telecommunication cables, as well as to cables of mixed power/telecommunications type. In this respect, therefore, hereinbelow in the present description and in the claims which follow the term "conductor" means a conductor of metal type, of circular or sector-shaped configuration, or an optical fibre, or an optical fibre or of mixed electrical/optical type.

Thus, in a first aspect, the present invention relates to a self-extinguishing cable comprising at least one conductor and at least one flame-retardant coating in a position radially external to said at least one conductor, characterized in that said at least one flame-retardant coating comprises an expanded polymeric material which includes at least one intumescent agent as defined hereinbelow in the present description.

In accordance with one particular embodiment, the self-extinguishing cable of the present invention comprises a polymeric sheath in a position radially external to said flame-retardant coating.

In accordance with the invention, said intumescent agent comprises at least one phosphorus-containing compound and/or at least one nitrogen-containing compound or one or more compounds containing both phosphorus and nitrogen.

In accordance with a further embodiment, the expanded polymeric material of the flame-retardant coating of the self-extinguishing cable of the present invention includes, together with the intumescent agent, at least one mineral filler, preferably a flame-retardant mineral filler.

In a second aspect, the present invention relates to a method for giving a cable flame-retardant and impact-resistance properties, said method including a stage of giving said cable at least one coating comprising an expanded polymeric material including at least one intumescent agent.

In the present description and in the claims which follow, the term "intumescent agent" means a compound comprising phosphorus and/or nitrogen, which, once combined with a base polymeric material, in the event of exposure to high temperatures or to the direct action of a flame, is capable of bringing about the formation of an expanded carbon-based residue (char) which inhibits the combustion propagation.

It is believed that, during combustion, the nitrogen, on the one hand, generates nitrogen gas which expands the polymeric material, and the phosphorus, on the other hand, contributes towards increasing the amount of carbon-based residue ("char") from the combustion (i.e. the combustion ash) and towards giving this residue high tenacity. In this way, a solid layer is produced between the polymeric material and the surrounding external environment, thus inhibiting the combustion propagation. Specifically, said layer, by acting as a physical barrier placed between the polymeric material still to be burnt and the flame, protects said material and prevents fresh oxygen from reaching the material and further feeding the flame. In addition, the expansion due to the action of the nitrogen generates a thermal insulation for the layers of material which are still intact, i.e. not affected by the action of the flame, by virtue of the fact that the thermal conductivity of the expanded material is considerably less than the thermal conductivity of the non-expanded material. A synergistic action between phosphorus and nitrogen is thus produced.

In accordance with one particular embodiment, if the base polymeric composition already intrinsically contains nitrogen (for example if a polymeric composition based on polyamides or polyurethane is used), the intumescent agent can consist solely of a compound of phosphorus-containing type. This is because, during the combustion, the nitrogen required for the intumescent action is supplied by the base polymeric composition.

BRIEF DESCRIPTION OF THE DRAWINGS

This description, given hereinbelow, is in reference to the attached drawings, which are provided purely for illustrative purposes and do not imply any limitation, and in which.

DETAILED DESCRIPTION OF THE INVENTION

Figure 1:
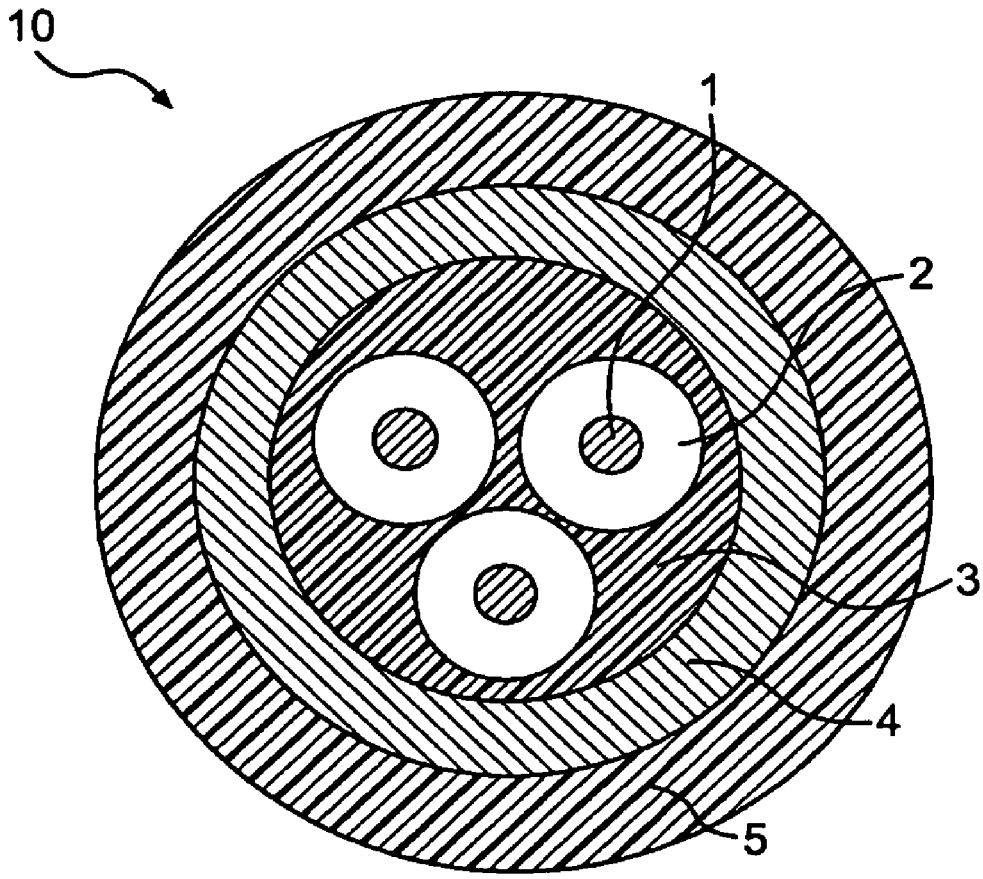
FIG. 1 (PRIOR ART)
FIG. 1 shows an electrical cable for power transmission according to the state of the art, of the tripolar type with metal armouring.

Hereinbelow in the present description, the expression "expanded polymeric material" means a polymeric material with a predetermined percentage of "free" space inside the material, i.e. a space not occupied by the polymeric material, but rather by gas or air.

In general, this percentage of free space in an expanded polymer is expressed by means of the "expansion degree" (G), defined as follows:

$$G=(d_0/d_e-1)*100$$

in which $d_0$ indicates the density of the non-expanded polymer and $d_e$ indicates the apparent density measured for the expanded polymer.

The expanded polymeric coating with flame-retardant properties according to the present invention is obtained from an expandable polymer optionally subjected to crosslinking, after expansion, as indicated in greater detail hereinbelow in the present description.

This expandable polymer can be selected from the group comprising: polyolefins, copolymers of various olefins, olefin/unsaturated ester copolymers, polyesters, polycarbonates, polysulphones, phenolic resins, ureic resins, and mixtures thereof. Examples of suitable polymers are: polyethylene (PE), in particular low-density PE (LDPE), medium-density PE (MDPE), high-density PE (HDPE) and linear low-density PE (LLDPE); polypropylene (PP); elastomeric ethylene/propylene copolymers (EPM) or ethylene/propylene/diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA), ethylene/butyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters, such as polyethylene terephthalate (PET) or polybutylene terephthalate (PBT); and copolymers or mechanical blends thereof.

Preferably, the polymeric material is a polyolefinic polymer or copolymer based on ethylene and/or propylene, and in particular chosen from:

(a) copolymers of ethylene with an ethylenically unsaturated ester, for example vinyl acetate or butyl acetate, in which the amount of unsaturated ester is generally between 5% and 80% by weight, preferably between 10% and 50% by weight;

(b) elastomeric copolymers of ethylene with at least one $C_3$–$C_{12}$ α-olefin, and optionally a diene, preferably ethylene/propylene copolymers (EPR) or ethylene/propylene/diene copolymers (EPDM), preferably having the following composition: 35 mol %–90 mol % of ethylene, 10 mol %–65 mol % of α-olefin, 0 mol %–10 mol % of diene (for example 1,4-hexadiene or 5-ethylidene-2-norbornene);

(c) copolymers of ethylene with at least one $C_4$–$C_{12}$ α-olefin, preferably 1-hexene, 1-octene and the like and optionally a diene, generally having a density of between 0.86 g/cm$^3$ and 0.90 g/cm$^3$ and the following composition: 75 mol %–97 mol % of ethylene, 3 mol %–25 mol % of α-olefin, 0 mol %–5 mol % of a diene;

(d) polypropylene modified with ethylene/$C_3$–$C_{12}$ α-olefin copolymers, in which the weight ratio between the polypropylene and the ethylene/$C_3$–$C_{12}$ α-olefin copolymer is between 90/10 and 30/70, preferably between 50/50 and 30/70.

For example, products which fall within class (a) are the commercial products Elvax® (Du Pont), Levapren® (Bayer) and Lotryl® (Elf-Atochem). Those which fall in class (b) are the products Dutral® (Enichem) and Nordel® (Dow-Du Pont). Those which fall in class (c) are the products Engage® (Dow-Du Pont) and Exact® (Exxon). Polypropylene modified with ethylene/α-olefin copolymers can be found on the market under the brand names Moplen® or Hifax® (Montell), or Fina-Pro® (Fina), and the like.

Products of class (d) which are particularly preferred are thermoplastic elastomers comprising a continuous matrix of a thermoplastic polymer, for example polypropylene, and small particles (generally with a diameter of about 1–10 μm) of a vulcanized elastomeric polymer, for example crosslinked EPR or EPDM, dispersed in the thermoplastic matrix. The elastomeric polymer can be incorporated into the thermoplastic matrix in non-vulcanized form and then dynamically crosslinked during the process by means of addition of a suitable amount of a crosslinking agent. Alternatively, the elastomeric polymer can be vulcanized separately and then dispersed in the thermoplastic matrix in the form of small particles. Thermoplastic elastomers of this type are described, for example, in documents U.S. Pat. No. 4,104,210 and EP-324 430.

Of the polymeric materials, particular preference was given to a polypropylene with high mechanical strength in the molten state (high melt strength polypropylene), as described, for example, in U.S. Pat. No. 4,916,198, which is commercially available under the brand name Profax® (Montell S.p.A.). That document explains a process for producing said polypropylene via a step of irradiating a linear polypropylene. This is carried out using high-energy ionizing radiation for a period of time which is sufficient to result in the formation of a large amount of long branchings of the chain. A suitable treatment of the irradiated material is moreover envisaged at the end of said step so as to deactivate essentially all of the free radicals present in the irradiated material.

Even more preferably, among the polymeric material particular preference is given to a polymeric composition comprising the abovementioned highly-branched polypropylene, in an amount generally of between 30% and 70% by weight, blended with a thermoplastic elastomer of the type belonging to class (d) above, in an amount generally of between 30% and 70% by weight, said percentages being expressed relative to the total weight of the polymeric composition. This polymeric composition is particularly advantageous since the intumescent agent can be easily and efficiently incorporated into said composition, which, once said agent has been added, presents no problems during the expansion process envisaged for formation of the flame-retardant coating of the present invention. The use of this polymeric coating moreover makes it possible to prepare a continuous and uniform flame-retardant coating along the length of the cable.

In accordance with the invention, the expanded polymeric composition incorporates an intumescent agent as defined above in the present description. Among the phosphorus-containing compounds constituting said intumescent agent which may be mentioned are, for example, phosphorous or phosphoric acid (phosphites, phosphates or polyphosphates), organic esters or polyesters of phosphoric acid (mono-, di- or tri-alkyl or -aryl phosphates or polyphosphates), phosphites (mono-, di- or tri-alkyl or -aryl phosphites), phosphonates or polyphosphonates (mono- or di-alkyl or -aryl phosphonates or polyphosphonates) in which the alkyl groups are preferably ($C_2$–$C_{12}$)alkyl groups while the aryl groups are preferably phenyl, mono-, di- or trisubstituted phenyl, in which the substituent is chosen, independently, from ($C_1$–$C_4$)alkyl and hydroxyl.

In general, since the use of additives in the form of water-soluble salts can result in unwanted variations in the electrical insulating capacity of the insulating coating, where present, it is preferred to avoid the use of phosphorus-containing additives in the form of water-soluble salts.

In particular, it is preferred to use organophosphorus compounds which have plasticizing properties, such as, for example, the abovementioned phosphoric acid esters; among these, the preferred esters are dialkyl, diaryl, alkylaryl, trialkyl, triaryl, dialkylaryl or alkyldiaryl phosphates, in which the alkyl groups are preferably ($C_2$–$C_{12}$)alkyl groups while the aryl groups are preferably phenyl or mono-, di- or trisubstituted phenyl, in which the substituent is chosen, independently, from ($C_1$–$C_4$)alkyl and hydroxyl; triaryl or alkyldiaryl phosphates being particularly preferred. Examples of these compounds are isopropyl diphenyl phosphate, t-butyl diphenyl phosphate, 2-ethylhexyl diphenyl phosphate, isodecyl diphenyl phosphate, triphenyl phosphate, trixylyl phosphate or tricresyl phosphate. Triphenyl phosphate is preferably used.

Among the nitrogen-containing compounds, if used, the ones which can preferably be used are those capable of giving the desired synergistic effect with the phosphorus-containing compounds described above. Examples of such compounds are: inorganic salts, for example ammonium salts, or organic compounds and the organic salts thereof, such as guanidine, melamine and derivatives thereof, for example melamine cyanurate or guanidylurea, and salts thereof. Also in the case of nitrogen-containing compounds, whenever it is necessary to coat the conductor with a coating which ensures adequate electrical insulation, it is preferable to avoid the use of nitrogen-containing derivatives in the form of water-soluble salts. In particular, it is preferred to use simple organic compounds with a high content of nitrogen, such as, for example, melamine, guanidine, urea and derivatives thereof (melamine cyanurate or guanidylurea), the use of melamine being particularly preferred. Due to the toxicity problems which may occur with the products of degradation of nitrogen-containing compounds, it is preferable that the amount of said compounds should be maintained at the lowest level which is compatible with the desired synergistic effect.

The intumescent agent according to the present invention can also consist of compounds containing both phosphorus and nitrogen, such as, for example: phosphates polyphosphates or pyrophosphates of ammonium, of guanidine, of melamine or of piperazine, or corresponding mixed phosphates; as well as phosphoramides, phosphorylamides, amidophosphonates and phosphonitrile compounds, or mixtures thereof.

In accordance with the present invention, the amount by weight of intumescent agent, relative to the total weight of the base composition, is generally between 1% and 60%, preferably between 2% and 50% and even more preferably between 5% and 30%.

As anticipated above, in accordance with a further embodiment, besides the intumescent agent mentioned above, the expanded polymeric material for making the flame-retardant coating according to the present invention also incorporates one or more mineral fillers of known type, said fillers advantageously being of flame-retardant type. Preferably, these mineral fillers coupled with the intumescent agent are introduced in an amount of not more than 60 phr (parts by weight per 100 parts by weight of rubber) so as not to have a detrimental effect on the desired expansion degree. Preferably, said mineral fillers consist of magnesium hydroxide and/or calcium carbonate.

An electrical cable (10) for medium-voltage power transmission according to the prior art is illustrated in cross section in FIG. 1.

This cable (10) is of the tripolar type and comprises three conductors (1), each coated with a layer (2) which functions as electrical insulation. As mentioned above, this semi-finished structure (1, 2) has been defined by the term "core".

Said insulating layer (2) can consist of a halogen-free, crosslinked or non-crosslinked polymeric composition with electrical insulating properties, which is known in the art, chosen, for example, from: polyolefins (homopolymers or copolymers of various olefins), ethylenically unsaturated olefin/ester copolymers, polyesters, polyethers, polyether/polyester copolymers and blends thereof. Examples of such polymers are: polyethylene (PE), in particular linear low-density PE (LLDPE); polypropylene (PP); propylene/ethylene thermoplastic copolymers; ethylene/propylene rubbers (EPR) or ethylene/propylene/diene rubbers (EPDM); natural rubbers; butyl rubbers; ethylene/vinyl acetate (EVA) copolymers; ethylene/methyl acrylate (EMA) copolymers; ethylene/ethyl acrylate (EEA) copolymers; ethylene/butyl acrylate (EBA) copolymers; ethylene/α-olefin copolymers, and the like.

With reference to FIG. 1, the three cores are roped together and the star-shaped areas thus obtained between said cores are filled with a flame-retardant composition of known type (generally comprising a polymeric base to which is added a flame-retardant filler of mineral type) to define a filling layer (3) having a structure of essentially circular cross-section.

In a position radially external to said filling layer (3) is placed conventional metal armouring (4) which, as mentioned above, can consist of metal wires, for example steel wires, a metal screen in the form of a continuous tube, made of aluminium, lead or copper, or a metal band in the form of a tube and welded or sealed with a suitable adhesive in order to ensure adequate leaktightness. In general, said metal armouring (4) is obtained by means of armouring apparatus with wires or strips of known type.

Finally, said metal armouring (4) is coated with an outer polymeric sheath (5) produced from a flame-retardant composition of known type.

Figure 2:
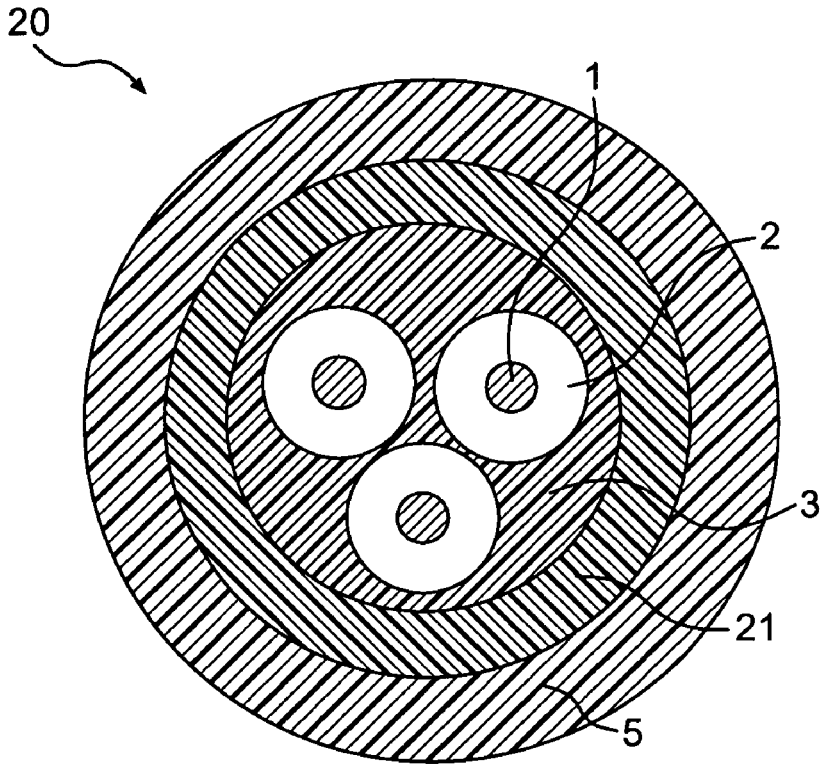
FIG. 2 shows a first embodiment of a tripolar cable according to the invention.

FIG. 2 illustrates, in cross section, a first embodiment of a self-extinguishing electrical cable (20) according to the present invention, of tripolar type, for low-voltage power transmission.

For simplicity of description, in the attached figures, similar or identical components are labelled with the same reference signs.

In a similar manner to that represented in FIG. 1 with reference to a self-extinguishing cable (10) of the prior art, the cable (20) of the invention comprises three conductors (1), each coated with an insulating coating (2) to form three separate "cores" roped together. The star-shaped areas obtained between said cores are filled with a flame-retardant composition of known type to constitute an insulating filling layer (3), outside which is placed a flame-retardant coating made of expanded polymeric material (21) according to the invention. The latter is, in turn, coated with an outer polymeric sheath (5) produced from a flame-retardant composition of known type comprising a polymeric base and an inorganic flame-retardant filler.

Inorganic flame-retardant fillers which can be used are hydroxides, hydrated oxides, salts or hydrated salts of metals, in particular of calcium, aluminium or magnesium, such as: magnesium hydroxide, alumina trihydrate, magnesium hydrated carbonate, magnesium carbonate, mixed hydrated carbonate of magnesium and calcium, mixed magnesium and calcium carbonate, or mixtures thereof. The flame-retardant filler is generally used in the form of particles which are untreated or surface-treated with saturated or unsaturated fatty acids containing from 8 to 24 carbon atoms, or metal salts thereof, such as, for example: oleic acid, palmitic acid, stearic acid, isostearic acid, lauric acid; stearate or oleate of magnesium or zinc; and the like. In order to increase the compatibility with the polymeric matrix, the flame-retardant filler can also be surface-treated with suitable coupling agents, for example organic silanes or titanates such as vinyltriethoxysilane, vinyltriacetylsilane, tetraisopropyl titanate, tetra-n-butyl titanate, and the like. The amount of flame-retardant filler to be added is predetermined so as to obtain a cable which is capable of satisfying the typical flame-resistance tests, for example the test according to standards IEC 332-1 and IEC 332.3 A,B,C. In general, this amount is between 10% and 90% by weight, preferably between 30% and 80% by weight, relative to the total weight of the flame-retardant composition.

In addition, as is known, examples of the polymeric base, with which said flame-retardant filler is coupled, are: low-density polyethylene (LDPE) (d=0.910-0.926 g/cm$^3$); copolymers of ethylene with α-olefins; polypropylene (PP); ethylene/α-olefin rubbers, in particular ethylene/propylene rubbers (EPR), ethylere/propylene/diene rubbers (EPDM); natural rubber; butyl rubbers; and blends thereof. Particularly preferred are the copolymers which can be obtained by copolymerization of ethylene with at least one α-olefin containing from 3 to 12 carbon atoms, and optionally with a diene, in the presence of a "single-site" catalyst, in particular a metallocene catalyst or a Constrained Geometry Catalyst.

For the purpose of promoting the compatibilization between the flame-retardant filler and the polymeric matrix, a coupling agent capable of increasing the interaction between the active groups of the flame-retardant filler and the polymeric chains can be added, as is known, to the compound. This coupling agent can be chosen from those known in the prior art, for example: silane compounds which are saturated or which contain at least one ethylenic unsaturation; epoxides containing an ethylenic unsaturation; monocarboxylic or, preferably, dicarboxylic acids containing at least one ethylenic unsaturation, or derivatives thereof, in particular anhydrides or esters, for example maleic anhydride.

The amount of coupling agent to be added to the compound can vary mainly as a function of the type of coupling agent used and of the amount of flame-retardant filler added. It is generally between 0.01% and 5%, preferably between 0.05% and 2%, by weight relative to the total weight of the base polymeric blend.

Other conventional components, such as antioxidants, processing co-adjuvants, lubricants, pigments, other fillers and the like, can be added to the abovementioned flame-retardant compositions (polymeric base+flame-retardant filler). Conventional antioxidants which are suitable for this purpose are, for example: polymerized trimethyldihydroquinoline, 4,4'-thiobis(3-methyl-6-tert-butyl)phenol; pentaerythrityl tetra [3-(3,5-di-tert-butyl-4-hydroxyphenyl) propionate], 2,2'-thiodiethylenebis[3-(3,5-di-tert-butyl-4-hydroxyphenyl) propionate], and the like, or mixtures thereof.

Figure 3:
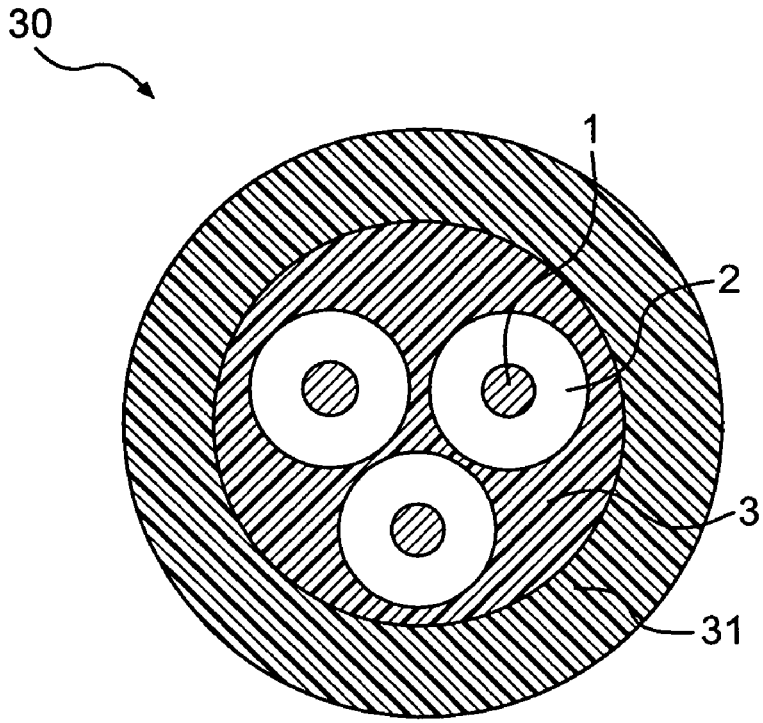
FIG. 3 shows a second embodiment of a tripolar cable according to the invention.

FIG. 3 illustrates, in cross section, a second embodiment of a self-extinguishing electrical cable (30) according to the present invention, in which the flame-retardant coating made of expanded material (31) represents the radially outermost layer of said cable (30). In contrast with cable (20) shown in FIG. 2, the cable (30) of this second embodiment is not provided with any outer polymeric sheath (5), and, by virtue of its flame-retardant and mechanical-strength properties, the flame-retardant coating (31) represents the interface between this cable (30) and the external environment surrounding it.

Figure 4:
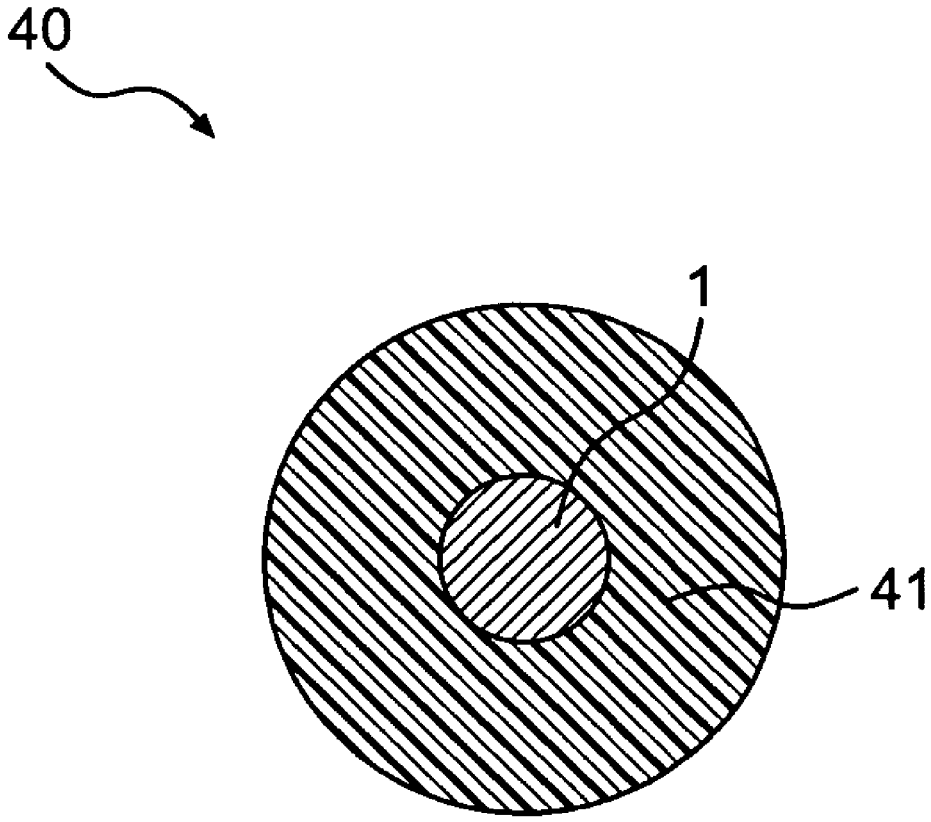
FIG. 4 shows a further embodiment of a unipolar cable according to the invention.

Finally, FIG. 4 illustrates, in cross section, a further embodiment of a self-extinguishing electrical cable (40) according to the present invention, of unipolar type, for example a telecommunication cable or a data transmission cable. This cable (40) consists of only one conductor (1), outside which is positioned a flame-retardant expanded polymeric coating (41) according to the invention. In accordance with this embodiment, the self-extinguishing cable (40) does not have any insulating layer between the conductor (1) and the flame-retardant coating made of expanded polymeric material (41), and likewise, in a similar manner to that illustrated in FIG. 3, it is not provided with an outer protective sheath (5). In this way, the flame-retardant coating (41) provides, besides the desired flame-retardant action, both the electrical insulation function and a function of protection against the outside, in particular with respect to accidental impacts.

In one embodiment which is not illustrated, said flame-retardant coating (41) can be coated externally with a protective sheath which has a flame-retardant formulation of known type.

The figures mentioned above show only some of the possible embodiments of cables in which the present invention can be advantageously used.

It is clear that suitable modifications may be made to the embodiments mentioned above, through this does not imply any limitation on the application of the present invention. For example, cores with sectorial cross section can be envisaged, such that when these cores are combined together a cable with approximately circular cross section is formed, without the need to provide for a filling layer (3); the flame-retardant coating according to the invention is then extruded directly onto these cores combined together as above, followed by the extrusion of the outer polymeric sheath (5).

Further approaches are known to those skilled in the art, who are capable of evaluating the most convenient solution as a function, for example, of the costs, where the cable is laid (aerial, inserted in pipes, buried directly in the ground, inside buildings, under the sea, etc.) and of the working temperature of the cable (maximum and minimum temperatures, changes of environmental temperature).

As regards the process for producing a cable according to the present invention, the main stages which characterize said process when a unipolar cable is to be prepared are given hereinbelow. When it is desired to produce a multipolar cable, for example of tripolar type, the process described for a unipolar cable may be suitably modified on the basis of the indications given and of the technical knowledge of a person skilled in the art.

The insulating layer (2), preferably obtained from a polyolefin chosen from those mentioned above, in particular polyethylene, polypropylene, ethylene/propylene copolymers and the like, is applied by extrusion over a conductor element (1) unwound from a suitable reel. At the end of the extrusion stage, the material is preferably crosslinked according to known techniques, for example using peroxides or via silanes.

In accordance with the present invention, the flame-retardant coating made of expanded polymeric material is then prepared. Said polymeric material is premixed with the intumescent agent, and with optional additives (for example antioxidants and co-adjuvants for processing the polymeric material), according to methods known in the art. For example, the mixing can be carried out in an internal mixer of the type with tangential rotors (Banbury mixer) or with interpenetrating rotors, or alternatively in continuous mixers such as those of the Ko-kneader type (Buss mixer) or of the type with co-rotating or counter-rotating twin screws.

Thus, once the mixing has been carried out, the extrusion operation of the flame-retardant coating directly over the insulating layer (2) mentioned above is carried out, and the stage of expanding the polymeric material is carried out during said extrusion operation. This expansion can take place either chemically, by adding a suitable expanding agent, i.e. an agent capable of generating a gas under predetermined pressure and temperature conditions, or physically, by injecting a gas at high pressure directly into the extruder cylinder. Examples of suitable expanding agents are: azodicarbamide, para-toluenesulphonyl hydrazide, mixtures of organic acids (for example citric acid) with carbonates and/or bicarbonates (for example sodium bicarbonate), and the like. Examples of gases which can be injected at high pressure into the extruder cylinder are: nitrogen, carbon dioxide, air, low-boiling hydrocarbons, for example propane or butane, halogenated hydrocarbons, for example methylene chloride, trichlorofluoromethane, 1-chloro-1,1-difluoroethane, and the like, or mixtures thereof.

Preferably, the aperture of the extruder head has a diameter which is less than the final diameter of the cable provided with the desired flame-retardant coating, such that the expansion of the polymer outside the extruder results in the desired diameter being reached.

It has been observed that, under equivalent extrusion conditions (such as rotation speed of the screw, speed of the extrusion line, diameter of the extruder head), one of the process variables which has the greatest influence on the expansion degree is the extrusion temperature. In general, it is difficult to obtain a sufficient expansion degree for extrusion temperatures below 130° C.; the extrusion temperature is preferably at least 140° C., in particular about 180° C. Normally, increasing the extrusion temperature results in a greater expansion degree.

In addition, it is possible to control the expansion degree of the polymer to a certain extent by modifying the cooling rate. Specifically, by appropriately slowing down or advancing the cooling of the polymer which forms the expanded coating at the extruder outlet, the expansion degree of said polymeric material can be increased or decreased.

In accordance with the present invention, the expansion degree can range from 5% to 500%, preferably from 10% to 200%, and even more preferably from 20% to 150%.

The expanded polymeric material can be crosslinked or non-crosslinked. The crosslinking is carried out, after the stage of extrusion and expansion, according to known techniques, in particular by heating in the presence of a radical initiator, for example an organic peroxide such as dicumyl peroxide, optionally in the presence of a crosslinking co-agent such as, for example, 1,2-polybutadiene, triallyl cyanurate or triallyl isocyanurate.

Typically, for an electrical cable for low-voltage power transmission or distribution, the thickness of the flame-retardant coating according to the present invention is preferably between 0.5 mm and 6 mm, more preferably between 1 mm and 4 mm.

As stated, the production process described above envisages several successive extrusion stages. Advantageously, this process can be carried out in a single pass, for example by means of the "tandem" technique, in which three separate extruders arranged in series are used. Preferably, said process is carried out by co-extrusion using only one extrusion head.

Some illustrative examples will now be given to describe the invention in further detail.

EXAMPLE 1

A compound capable of producing a flame-retardant coating according to the present invention, i.e. a layer of expanded polymeric material incorporating inside of it an intumescent agent as defined above, was prepared. The composition of said compound is given in Table 1 (expressed in parts by weight per 100 parts by weight of base polymer, i.e. in phr).

The components of the compound were mixed in a closed Werner mixer (working volume of 6 l), while simultaneously loading the base polymer and the intumescent agent (usually, as stated previously, other additives such as antioxidants and co-adjuvants for processing the polyolefins are also added); mixing was carried out for about 5 minutes. At the end of this operation, the compound, unloaded at a temperature of about 210° C.–220° C., was then further mixed in an open mixer. The strips of compound obtained downstream of said open mixer were finally subjected to a pelletization operation.

TABLE 1

| | |
|---|---|
| HIGRAN SD 817 ® | 100 |
| SPINFLAM MF 83 ® | 25 |

HIGRAN SD 817 ® (Montell): high melt strength polypropylene; SPINFLAM MF 83 ® (Montell): mixed pyrophosphate of melamine and piperazine, containing 22% by weight of nitrogen and 19% by weight of phosphorus.

EXAMPLE 2

A low-voltage cable was prepared according to a construction scheme similar to that given in FIG. 2, the only difference being that the cable prepared was of bipolar type (rather than of tripolar type like the one illustrated in said FIG. 2).

Each of the two cores possessed by said cable consisted of a copper conductor (of cross section equal to 2.5 $mm^2$) coated on the extrusion line with a 0.7 mm thick insulating layer based on silane-crosslinked polyethylene.

A layer of filling having a flame-retardant composition of known type was deposited, by extrusion, on said cores (each having an outside diameter of about 3.3 mm). More specifically, a flame-retardant composition comprising Engage 8452® (ethylene/octene copolymer from metallocene catalysis), Hydrofy G5® (ground natural magnesium hydroxide) and zinc stearate was used in this example. The thickness of said filling layer was equal to about 0.6 mm in the portion radially external to said cores, i.e. on the extrados regions of these cores. A Bandera 80 mm single-screw extruder in configuration 25 D was used to deposit the filling layer.

In a successive stage, a flame-retardant coating having the composition given in Table 1 of Example 1 was deposited on the filling layer thus obtained. Said coating layer had a thickness equal to 1 mm, and the extrusion was carried out using the same extruder mentioned above.

Expansion of the flame-retardant coating was obtained chemically, by adding into a hopper 2% by weight (relative to the total weight) of the expanding agent Hydrocerol® CF 70 (carboxylic acid/sodium bicarbonate), produced by Boehringer Ingelheim.

The material constituting the flame-retardant coating had a final density equal to 0.55 kg/dm$^2$ and an expansion degree equal to about 80%.

In a successive stage, an outer protective sheath having a flame-retardant composition of known type was deposited over the flame-retardant coating. More specifically, a flame-retardant composition comprising Engage 8003® (ethylene/octene copolymer from metallocene catalysis), Hydrofy GS 2.5® (ground natural magnesium hydroxide) and stearic acid was used. The thickness of said sheath was equal to about 1.4 mm and, in this case too, the extrusion was carried out using the same extruder as mentioned above. Tables 2 and 3 give the temperature profile and the operating parameters of the extruder used to obtain the filling layer, the flame-retardant coating and the outer sheath, respectively.

The cable was then cooled in water and wound on a reel.

TABLE 2

| Extruder zone | Extruder for the filling layer (° C.) | Extruder for the flame-retardant coating (° C.) | Extruder for the outer sheath (° C.) |
|---|---|---|---|
| Zone 1 | 80 | 180 | 150 |
| Zone 2 | 100 | 185 | 160 |
| Zone 3 | 110 | 190 | 165 |
| Zone 4 | 110 | 195 | 170 |
| Zone 5 | 110 | 200 | 180 |
| Extruder flange/head | 110 | 210 | 190 |
| Head | 110 | 210 | 190 |

TABLE 3

| Parameter | Extruder of the filling layer | Extruder of the flame-retardant coating | Extruder of the outer sheath |
|---|---|---|---|
| Diameter of positive mould | 7.0 mm | 8.0 mm | 10.2 mm |
| Diameter of negative mould | 7.8 mm | 8.8 mm | 12.0 mm |
| Cable diameter at end of stage | 7.5 mm | 9.7 mm | 12.5 mm |
| Extruder pressure | 150 bar | 80 bar | 175 bar |
| Extruder screw speed | 2 revolutions/min | 1 revolution/min | 2.7 revolutions/min |
| Extrusion line speed | 3 m/min | 4 m/min | 2.5 m/min |

Test of Flame Resistance

The self-extinguishing cable of Example 2 was subjected to the flame resistance test according to standard IEC 332/3C (second edition, 1992-03) and satisfied the above-mentioned test demonstrating that it has the required flame-retardant properties.

Tests Carried Out on Fumes

A plurality of analyses was also carried out on the fumes evolved on combustion of a self-extinguishing cable of Example 2. These analyses were performed in order to evaluate the hazardousness (see, for example, the toxicity index) of a cable especially in the event of a fire developing in a closed or underground environment, as mentioned previously. The results of the tests are given in Table 4 and show that the cable according to the invention satisfies the standards in force.

TABLE 4

| | |
|---|---|
| Toxicity index of the fumes (CEI 20-37/7) (Maximum permitted value: 2) | 1.4 (weighted average) |
| pH of the fumes (CEI 20-37/3) (Minimum permitted value: 4.3) | 5.6 (logarithmic weighted average) |
| Conductivity of the fumes (CEI 20-37/3) (Maximum permitted value: 100 μS/cm) | 15 μS/cm (weighted average) |
| Opacity of the fumes (CEI 20-37/4) (Minimum permitted transmittance: 70%) | 93% |

Test of Impact Resistance

To evaluate the impact resistance on a sample of cable according to the invention, impact tests were carried out followed by evaluation of the damage. This evaluation was carried out by means of a visual inspection of the cable at the point of impact.

This impact test was carried out by imposing an impact energy of about 9.3 Joules (J) on the cable by dropping, from a height of 35 mm, a 27 kg impacting wedge whose V-shaped end has a slightly rounded shape (radius of curvature equal to 1 mm). For the purposes of the present invention, the evaluation of the impact resistance was carried out on a single impact.

At the end of the test, the outer polymeric sheath, the flame-retardant coating of the invention and the filling layer were removed from the zone of impact so as to evaluate the residual deformation on the insulating coating. The sample, subjected to visual inspection, showed a very slight residual deformation on the insulator, which bears witness to the fact that the flame-retardant coating made of expanded polymeric material according to the invention absorbed the impact in an excellent manner.

EXAMPLE 3 (COMPARATIVE)

A self-extinguishing cable similar to that of Example 2, but lacking the flame-retardant coating according to the invention, was prepared.

An impact resistance test as described above was then carried out on this type of cable. By visual inspection of the sample, at the end of said test, it was found that the insulating coating of the cable was appreciably damaged.

This comparative example thus demonstrates that the use of the flame-retardant coating made of expanded polymeric material according to the invention (Example 2) contributes towards substantially increasing the impact resistance of the self-extinguishing cable. Said flame-retardant coating is thus also particularly advantageous for self-extinguishing cables of non-armoured type.

EXAMPLE 4

A low-voltage cable of quadripolar type was prepared by means of a production process similar to that described in Example 2.

Each of the four cores possessed by said cable consisted of a copper conductor (of cross section equal to 120 $mm^2$) coated on an extrusion line with a 1.2 mm thick insulating layer based on silane-crosslinked polyethylene.

A filling layer with a flame-retardant composition similar to that of Example 2 and a thickness equal to 1.4 mm was deposited, by extrusion, onto said cores.

In a successive stage, a flame-retardant coating having the composition given in Table 1 and a thickness equal to 2 mm was deposited on the filling layer thus obtained. In a similar manner to that described in Example 2, the expansion of the flame-retardant coating was obtained by adding into a hopper 2% by weight (relative to the total weight) of the expanding agent Hydrocerol® CF70 and producing an expansion degree equal to about 60%.

In a subsequent extrusion, an outer protective sheath having a flame-retardant composition equal to that described in Example 2 and a thickness equal to about 2.5 mm was deposited on the flame-retardant coating thus obtained.

The cable was then cooled in water and wound on a reel.

Test of Flame Resistance

In a similar manner to that of Example 2, the self-extinguishing cable was subjected to the flame-resistance test according to standard IEC 332/3C, and satisfied the test.

Test of Impact Resistance

To evaluate the impact resistance on a sample of cable according to the invention, impact tests were carried out in accordance with the methodology described in Example 2. This impact test was carried out by imposing on the cable three different impact energy values, gradually increasing, obtained partly by varying the weight of the impacting wedge and partly by varying the drop height of this wedge. The results of this test, given in Table 5, were once again obtained by carrying out a visual inspection, and demonstrated that the self-extinguishing cable of the invention is capable of with standing impact energies even of high value with minimal damage to the insulating layer.

EXAMPLE 5 (COMPARATIVE)

A self-extinguishing cable similar to that of Example 4, but lacking the flame-retardant coating according to the invention, was prepared.

More specifically, in the light of the negative results obtained with reference to the non-armoured cable and also not provided with the flame-retardant coating of the invention (see the impact test of Example 3), in order to ensure higher mechanical protection, the cable of Example 4 was given conventional metal armouring equal to 2.5 mm in thickness. Said armouring was obtained by helically winding together steel wires 2.5 mm in diameter.

Underneath said armouring, in a similar manner to that of the cable of Example 3, this cable was given a 1.4 mm thick filling layer, while an outer polymeric sheath equal to 2.3 mm in thickness was provided in a position radially external to said armouring.

Test of Impact Resistance

The cable of Example 5 was subjected to the same impact tests as the cable of Example 4 by using the same energy values in both cases.

The results of these tests, given in Table 5 and compared with those obtained from the impact tests on the cable of Example 4 in accordance with the present invention, demonstrated that, for an equivalent applied impact energy, the self-extinguishing cable according to the invention is of high mechanical strength. More specifically, this mechanical strength is found to be even higher than that of a cable provided with metal armouring.

TABLE 5

| Applied impact energy | Cable of Example 4 (invention) | Cable of Example 5 (comparative) |
|---|---|---|
| 72 J (wedge weight: 27 kg) (drop height: 26.6 cm) | No damage | No damage |
| 108 J (wedge weight: 54 kg) (drop height: 20 cm) | Minimal damage | Clear damage |
| 125 J (wedge weight: 54 kg) (drop height: 23 cm) | Minimal damage | Extensive damage |

The invention presents a plurality of important advantages over the prior art.

Firstly, by comparing the process for producing the cable of the invention with the process for producing an armoured self-extinguishing cable of the prior art, the first is, as already suggested, considerably simpler than the second, especially when the cable of the invention is produced by co-extrusion. The reason for this is that, since the cable of the invention does not require a protective armoured coating, this being replaced, as mentioned, by the flame-retardant coating made of expanded polymeric material, the additional independent stage required for the production of the abovementioned armouring is not needed. Specifically, this stage introduces a discontinuity in the production process, thereby necessarily entailing higher investments in terms of plant engineering, higher maintenance costs, greater complexity of the planer logistics, as well as a considerable reduction in the production efficiency of this process. This is not encountered, however, in the process according to the invention, which allows the continuous production of a self-extinguishing cable by means of several successive extrusion stages or, preferably, via a single stage of co-extrusion advantageously carried out on the production line, without additional stages being added. This therefore means that it is possible to provide for a process of continuous type with appreciable advantages both in terms of plant costs and in terms of greater production efficiency by virtue of the greater simplicity of the process and the saving in time and resources, compared with the processes of the prior art. In addition, the self-extinguishing cable according to the present invention is advantageously lighter than the armoured cable of the prior art and the flame-retardant expanded coating has mechanical performance properties (especially as regards the impact resistance) that are better than those of a known cable which has a conventional flame-retardant coating. In addition, the Applicant has found that, in certain types of cable, the cable according to the invention has impact resistance which is even higher than that of a similar cable provided with a protective metal armouring.

The invention claimed is:

1. A self-extinguishing cable, comprising: at least one conductor and at least one flame-retardant coating in a position radially external to said at least one conductor, said at least one flame-retardant coating comprising an expanded polymeric material which incorporates at least one intumescent agent, wherein the thickness of said at least one flame-retardant coating is between 0.5 mm and 6 mm.

2. A self-extinguishing cable according to claim 1, wherein said cable comprises a polymeric sheath in a position radially external to said at least one flame-retardant coating.

3. A self-extinguishing cable according to claim 1, wherein said at least one intumescent agent comprises at least one phosphorus-containing compound.

4. A self-extinguishing cable according to claim 3, wherein said at least one phosphorus-containing compound is chosen from the group: phosphorous acid salts, phosphoric acid salts, organic esters of phosphoric acid, organic polyesters of phosphoric acid, and mixtures thereof.

5. A self-extinguishing cable according to claim 1, wherein said at least one intumescent agent comprises at least one nitrogen-containing compound.

6. A self-extinguishing cable according to claim 5, wherein said at least one nitrogen-containing compound is chosen from the group: ammonium salts, melamine, guanidine, melamine cyanurate, guanidylurea, urea and mixtures thereof.

7. A self-extinguishing cable according to claim 1, wherein said at least one intumescent agent comprises compounds containing both phosphorus and nitrogen.

8. A self-extinguishing cable according to claim 7, wherein said compounds are chosen from: phosphates, polyphosphates or pyrophosphates of ammonia, of guanidine, of melamine or of piperazine; phosphoramides, phosphorylamides, amidophosphonates, phosphonitrile compounds, and mixtures thereof.

9. A self-extinguishing cable according to claim 1, wherein said polymeric material is a polyolefinic polymer or copolymer based on ethylene and/or propylene.

10. A self-extinguishing cable according to claim 9, wherein said polymeric material is chosen from a) copolymers of ethylene with an ethylenically unsaturated ester, in which the amount of unsaturated ester is between 5% and 80% by weight;

b) elastomeric copolymers of ethylene with at least one $C_3$–$C_{12}$ α-olefin, and optionally a diene, having the following composition: 35 mol % to 90 mol % of ethylene, 10 mol % to 65 mol % of α-olefin, 0 mol % to 10 mol % of diene;

c) copolymers of ethylene with at least one $C_4$–$C_{12}$ α-olefin, and optionally a diene, generally having a density of between 0.86 and 0.90 g/cm$^3$; and d) polypropylene modified with ethylene/$C_3$–$C_{12}$ α-olefin copolymers, in which the weight ratio between the polypropylene and the ethylene/$C_{03}$–$C_{12}$ α-olefin copolymer is between 90/10 and 30/70.

11. A self-extinguishing cable according to claim 10, wherein the amount of unsaturated ester of said a) copolymers of ethylene with an ethylenically unsaturated ester is between 10% and 50% by weight.

12. A self-extinguishing cable according to claim 10, wherein the weight ratio between the polypropylene and the ethylene/$C_3$–$C_{12}$ α-olefin copolymer of said d) polypropylene modified with ethylene/$C_3$–$C_{12}$ α-olefin copolymers is between 50/50 and 30/70.

13. A self-extinguishing cable according to claim 1, wherein the expansion degree of said at least one flame-retardant coating is between 5% and 500%.

14. A self-extinguishing cable according to claim 13, wherein said expansion degree is between 10% and 200%.

15. A self-extinguishing cable according to claim 14, wherein said expansion degree is between 20% and 150%.

16. A self-extinguishing cable according to claim 1, wherein said thickness is between 1 mm and 4 mm.

17. A self-extinguishing cable according to claim 1, wherein the amount of said at least one intumescent agent is between 1% and 60% by weight relative to the total weight of the base composition.

18. A self-extinguishing cable according to claim 17, wherein said amount is between 2% and 50% by weight.

19. A self-extinguishing cable according to claim 18, wherein said amount is between 5% and 30% by weight.

20. A self-extinguishing cable according to claim 1, wherein said expanded polymeric material incorporates at least one mineral-filler.

21. A self-extinguishing cable according to claim 20, wherein the amount of said at least one mineral filler is not greater than 60 phr.

22. A self-extinguishing cable according to claim 20, wherein said at least one mineral filler is a flame-retardant filler.

23. A self-extinguishing cable according to claim 22, wherein said flame-retardant filler is chosen from the group: magnesium hydroxide, alumina trihydrate, magnesium hydrated carbonate, magnesium carbonate, mixed hydrated carbonate of magnesium and calcium, mixed carbonate of magnesium and calcium, and mixtures thereof.

24. A self-extinguishing cable according to claim 20, wherein said at least one mineral filler is an inorganic substance chosen from: glass fibres, calcinated kaolin, calcium carbonate and mixtures thereof.

25. A self-extinguishing cable according to claim 1, wherein said at least one flame-retardant coating satisfies the flame-resistance characteristics according to IEC standard 332/3C (second edition, 1992-03).

26. A self-extinguishing cable according to claim 1, wherein said at least one flame-retardant coating is obtained by extrusion.

27. A self-extinguishing cable according to claim 26, wherein expansion of said at least one flame-retardant coating is carried out during said extrusion by adding an expanding agent.

28. A self-extinguishing cable according to claim 27, wherein said expansion is obtained by injecting a gas at high pressure.

29. A self-extinguishing cable according to claim 27, wherein, after expansion, said polymeric material is subjected to crosslinking.

30. A method for imparting flame retardant and impact-resistance properties to a cable, comprising: applying to said cable at least one flame-retardant coating comprising an expanded polymeric material, which incorporates at least one intumescent agent, wherein the thickness of said at least one flame-retardant coating is between 0.5 mm and 6 mm.

31. A method according to claim 30, wherein said at least one flame-retardant coating is obtained by extrusion.

32. A self-extinguishing cable comprising: at least one conductor, an electrical insulation in a position radially external to said at least one conductor and at least one flame-retardant coating in a position radially external to said electrical insulation, said at least one flame-retardant coating comprising an expanded polymeric material which incorporates at least one intumescent agent; wherein the thickness of said at least one flame-retardant coating is between 0.5 mm and 6 mm.

* * * * *

UNITED STATES PATENT AND TRADEMARK OFFICE

CERTIFICATE OF CORRECTION

PATENT NO. : 7,049,524 B2
APPLICATION NO. : 10/203834
DATED : May 23, 2006
INVENTOR(S) : Sergio Belli et al.

It is certified that error appears in the above-identified patent and that said Letters Patent is hereby corrected as shown below:

column 19, line 54, "ethylene/$C_{03}$-$C_{12}$" should read --ethylene/$C_3$-$C_{12}$--.

Signed and Sealed this

Fifteenth Day of August, 2006

JON W. DUDAS
*Director of the United States Patent and Trademark Office*